US008671593B2

(12) United States Patent
Becker et al.

(10) Patent No.: US 8,671,593 B2
(45) **Date of Patent: *Mar. 18, 2014**

(54) LIGHTWEIGHT AND FLEXIBLE ARTICLE OF FOOTWEAR

(71) Applicant: Nike, Inc., Beaverton, OR (US)

(72) Inventors: David W. Becker, Beaverton, OR (US); Constantino Dendena, Pavia (IT); Kenneth Link, Portland, OR (US); Peter R. Savage, Aloha, OR (US); Michael Steen, Portland, OR (US); Nico Tseng, Taichung (TW)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/892,493

(22) Filed: May 13, 2013

(65) Prior Publication Data

US 2013/0333245 A1 Dec. 19, 2013

Related U.S. Application Data

(60) Continuation of application No. 12/862,034, filed on Aug. 24, 2010, now Pat. No. 8,458,928, which is a division of application No. 11/682,790, filed on Mar. 6, 2007, now Pat. No. 7,814,686.

(51) Int. Cl.
*A43B 13/12* (2006.01)
*A43B 13/16* (2006.01)

(52) U.S. Cl.
USPC ..... 36/102; 36/103; 36/73

(58) Field of Classification Search
USPC ..... 36/102, 73, 103, 30 R, 129, 59 R
See application file for complete search history.

(56) References Cited

U.S. PATENT DOCUMENTS

| | | | |
|---|---|---|---|
| 1,701,611 | A | 2/1929 | Glidden et al. |
| 2,185,993 | A | 1/1940 | Haskell |
| 2,312,841 | A | 3/1943 | Lewis |
| 2,599,970 | A | 6/1952 | Barrons |
| 2,920,008 | A | 1/1960 | Frieder et al. |
| 3,461,575 | A | 8/1969 | Tead et al. |
| 4,542,598 | A | 9/1985 | Misevich et al. |
| 4,676,010 | A | 6/1987 | Cheskin |
| 4,854,057 | A | 8/1989 | Misevich et al. |
| 4,897,939 | A | 2/1990 | Harrington |
| 4,944,099 | A | 7/1990 | Davis |

(Continued)

FOREIGN PATENT DOCUMENTS

| | | |
|---|---|---|
| FR | 2661321 | 10/1999 |
| GB | 2256784 | 12/1992 |
| WO | 2005004656 | 1/2005 |

OTHER PUBLICATIONS

Office Action mailed Jan. 19, 2010 in U.S. Appl. No. 11/682,790.

(Continued)

*Primary Examiner* — Ted Kavanaugh
(74) *Attorney, Agent, or Firm* — Plumsea Law Group, LLC

(57) ABSTRACT

An article of footwear with an outer member including slots that increase flexibility is disclosed. The outer member also includes an inner plate including a set of protective strips. The inner plate is disposed along an inner surface of the outer member so that the protective strips are aligned with and cover the slots in the outer member.

21 Claims, 8 Drawing Sheets

(56) References Cited

U.S. PATENT DOCUMENTS

| | | | |
|---|---|---|---|
| 5,024,007 | A | 6/1991 | DuFour |
| 5,052,130 | A | 10/1991 | Barry et al. |
| 5,786,057 | A | 7/1998 | Lyden et al. |
| 5,806,209 | A | 9/1998 | Crowley et al. |
| 5,918,338 | A | 7/1999 | Wong |
| 5,996,255 | A | 12/1999 | Ventura |
| 5,996,257 | A | 12/1999 | Harrison |
| 6,108,943 | A | 8/2000 | Hudson et al. |
| 6,115,945 | A | 9/2000 | Ellis, III |
| 6,178,663 | B1 | 1/2001 | Schoesler |
| 6,212,795 | B1 | 4/2001 | Nakabe et al. |
| 6,321,469 | B1 | 11/2001 | Cretinon |
| 6,412,196 | B1 | 7/2002 | Gross |
| 6,519,876 | B1 | 2/2003 | Geer et al. |
| 6,837,951 | B2 | 1/2005 | Rapaport |
| 7,070,845 | B2 | 7/2006 | Thomas et al. |
| 7,076,890 | B2 | 7/2006 | Grove et al. |
| 7,082,702 | B2 | 8/2006 | Cretinon |
| 7,320,188 | B2 | 1/2008 | Bathum |
| 7,607,241 | B2 | 10/2009 | McDonald et al. |
| 7,814,686 | B2 * | 10/2010 | Becker et al. ..... 36/102 |
| 8,458,928 | B2 * | 6/2013 | Becker et al. ..... 36/102 |
| 2004/0020080 | A1 | 2/2004 | Cox et al. |
| 2004/0221489 | A1 | 11/2004 | Hung |
| 2005/0257405 | A1 | 11/2005 | Kilgore |
| 2005/0262739 | A1 | 12/2005 | McDonald et al. |
| 2007/0199211 | A1 | 8/2007 | Campbell |
| 2007/0199213 | A1 | 8/2007 | Campbell et al. |
| 2007/0209230 | A1 | 9/2007 | Dillon et al. |
| 2010/0313447 | A1 | 12/2010 | Becker et al. |

OTHER PUBLICATIONS

Response to Office Action filed Feb. 16, 2010 in U.S. Appl. No. 11/682,790.

Office Action mailed Mar. 23, 2010 in U.S. Appl. No. 11/682,790.

Response to Office Action filed Jun. 15, 2010 in U.S. Appl. No. 11/682,790.

Notice of Allowance mailed Jun. 21, 2010 in U.S. Appl. No. 11/682,790.

* cited by examiner

LIGHTWEIGHT AND FLEXIBLE ARTICLE OF FOOTWEAR

This application is a continuation of U.S. Patent Publication Number US2010/0313447 A1, published Dec. 16, 2010 (application Ser. No. 12/862,034, filed Aug. 24, 2010), which is a division of U.S. application Ser. No. 11/682,790, filed Mar. 6, 2007, now U.S. Pat. No. 7,814,686, issued Oct. 19, 2010, both of which are herein incorporated by reference in their entirety.

BACKGROUND OF THE INVENTION

1. Field of the Invention

The present invention relates generally to footwear, and in particular an article of footwear with a lightweight and flexible outer member.

2. Description of Related Art

Articles of footwear with an articulated sole structure have been previously disclosed. McDonald et al. (U.S. patent number 2005/0262739) teaches an article of footwear that includes an upper and a sole structure secured to the upper. The sole structure includes a plurality of discrete sole elements that extend downward from a connecting portion disposed adjacent to the upper. The sole elements define a lower surface. Furthermore, the sole elements are separated by a plurality of sipes that extend upwards from the lower surface and into the sole structure.

Articles of footwear with reinforced portions along the sole or outsole have also been disclosed. Nakabe et al. (U.S. Pat. No. 6,212,795) teaches a shoe sole with a reinforced support structure. The Nakabe design includes a molded arched support member including a front support portion and a rear support portion. Harrison (U.S. Pat. No. 5,996,257) teaches a puncture resistant and impact resistant safety shoe insert. The shoe insert comprises a flexible steel plate and a layer of a puncture resistant material secured to the ends of the plate. Barrons (U.S. Pat. No. 2,599,970) teaches an orthopedic shoe including a reinforcing strip of canvas or the like secured to the underside of the insole, just above an upwardly projecting fold.

The prior art lacks provisions for increasing the flexibility of an outsole or outer member of an article of footwear using multiple slots. Additionally, the prior art lacks provisions for associating a rigid or puncture resistant material with regions of increased flexibility. There is a need in the art for an article of footwear that includes solutions to these problems.

SUMMARY OF THE INVENTION

An article of footwear with a lightweight and flexible outer member is disclosed. In one aspect the invention provides an article of footwear, comprising: an outer member and an inner plate disposed against an upper surface of the outer member; the inner plate comprising a set of protective strips disposed in a matrix; wherein the set of protective strips are aligned with and cover a set of slots in the outer member; and wherein the set of protective strips are more rigid than the outer member.

In another aspect, the outer member is made of a lightweight material.

In another aspect, the set of protective strips are made of carbon fiber tape.

In another aspect, the outer member is associated with an outsole.

In another aspect, the set of slots are disposed at a central portion of the outer member.

In another aspect, the outer member is made of phylon.

In another aspect, the invention provides an article of footwear, comprising: an outer member including a set of slots; the set of slots including a first slot that extends along a side periphery of the outer member; a set of protective strips associated with an upper side of the outer member; and wherein the set of slots are covered by and aligned with the set of protective strips on the upper side of the outer member and wherein a portion of at least one protective strip is exposed through a portion of the first slot along the side periphery.

In another aspect, the outer member is made of a lightweight and flexible material.

In another aspect, the set of protective strips are made of a rigid material.

In another aspect, the outer member is more flexible than the set of protective strips.

In another aspect, the set of protective strips are made of a carbon fiber tape.

In another aspect, the set of slots are disposed on a first portion of the outer member.

In another aspect, the first portion of the outer member is more flexible than a second portion disposed adjacent to the first portion.

In another aspect, the invention provides an article of footwear, comprising: an outer member including a set of slots disposed on a first portion; the set of slots extending through the entire depth of the outer member exposing a set of protective strips disposed on an inner side of the outer member; and wherein the set of slots are associated with a first width when the article of footwear is disposed in a horizontal mode and wherein the set of slots are associated with a second width that is greater than the first width when the article of footwear is in a flexing mode.

In another aspect, the set of protective strips are incorporated into a matrix material in the form of an inner plate.

In another aspect, the outer member is made of a flexible material.

In another aspect, the set of protective strips are made of a rigid material.

In another aspect, the outer member is more flexible than the rigid material.

In another aspect, the set of protective strips are made of a carbon fiber tape.

In another aspect, the first portion is a central portion of the outer member.

In another aspect, the invention provides an article of footwear, comprising: an inner plate comprising a set of protective strips disposed in a matrix; an upper comprising an inner lining and an outer lining; and where a first side of the inner plate is associated with an outer member and a second side of the inner plate is associated with the outer lining and an wherein the inner plate is disposed over a set of slots associated with the outer member.

In another aspect, the upper is associated with a midsole.

In another aspect, the midsole includes a bladder.

In another aspect, the first side of the inner plate is fixed to the outer member.

In another aspect, the second side of the inner plate is fixed to the outer lining.

In another aspect, the inner plate includes a set of protective strips associated with the set of slots.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
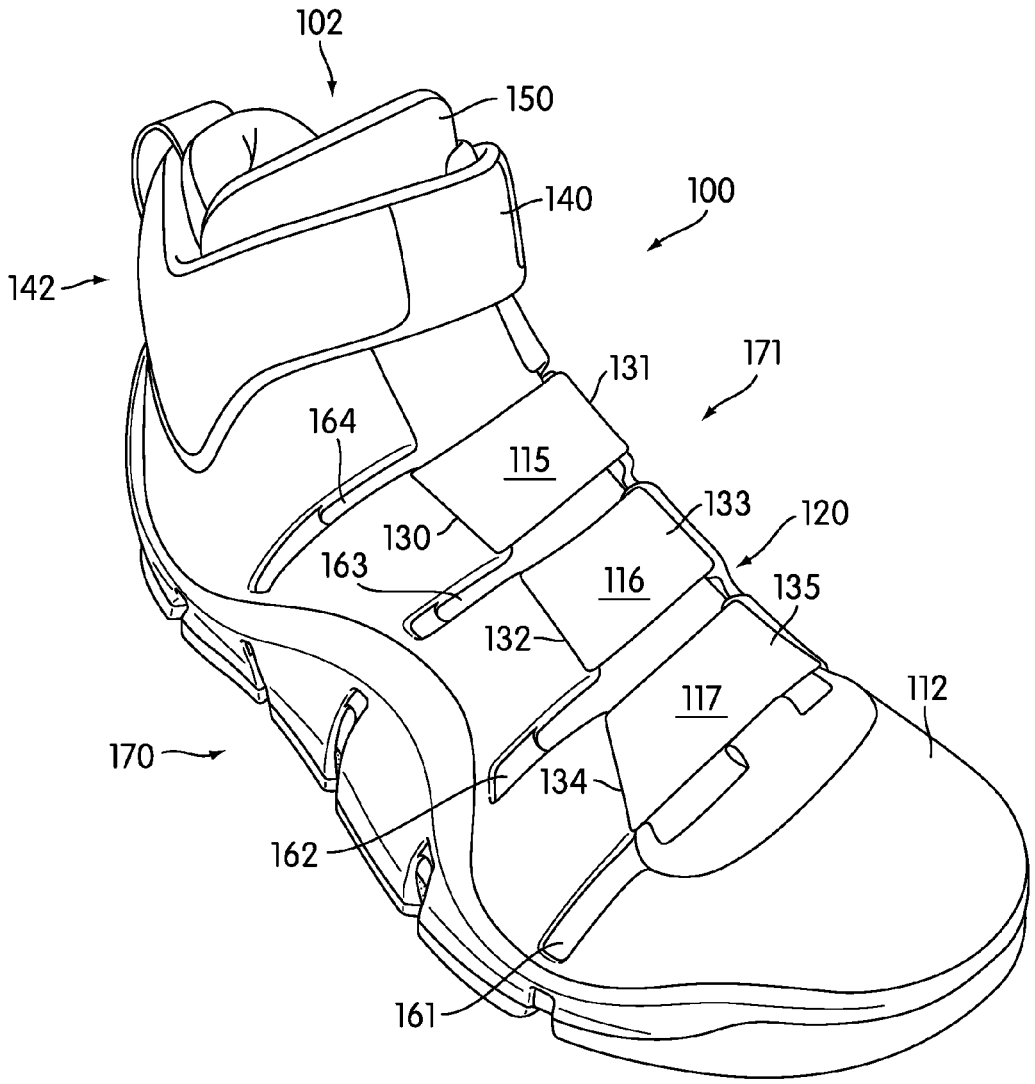
FIG. 1 is an isometric view of a preferred embodiment of an article of footwear.

FIG. 1 is an isometric view of a preferred embodiment of article of footwear 100. In a preferred embodiment, article of footwear 100 may be a basketball shoe. For clarity, the following detailed description discusses a preferred embodiment, however, it should be kept in mind that the present invention could also take the form of any other kind of footwear including, for example, running shoes, boots, sandals, as well as other kinds of footwear.

Article of footwear 100 preferably includes upper 112. Upper 112 may be made of any material that is both durable and flexible. By using durable and flexible materials, upper 112 will be able to accommodate a user's foot in a comfortable fashion while providing the necessary support to maintain the proper function of article of footwear 100. Materials of this type, from which upper 112 may be constructed, include, but are not limited to, natural fabrics, synthetic fabrics, leather and other materials that are used in the construction of shoe uppers.

Preferably, article of footwear 100 may include provisions for fastening upper 112 to a wearer's foot, once the wearer's foot has been inserted into article of footwear 100 via opening 102. In some embodiments, article of footwear 100 may include first flexible strap 115, second flexible strap 116 and third flexible strap 117. In a preferred embodiment, flexible straps 115, 116 and 117 may be disposed on instep portion 120 of upper 112.

In some embodiments, first flexible strap 115 may be fixed to upper 112 at first strap end 130 and second strap end 131. In other words, first strap 115 may not be adjustable, but instead is preferably constructed of an elastic or expandable material that may stretch to tighten upper 112 to a wearer's foot at instep portion 120. Likewise, second flexible strap 116 is preferably fixed to upper 112 at third strap end 132 and fourth strap end 133. Third flexible strap 117 may be fixed to upper 112 at fifth strap end 134 and sixth strap end 135. Preferably, flexible straps 116 and 117 function in a similar manner to first flexible strap 115, expanding and/or contracting to comfortably tighten upper 112 to a wearer's foot at instep portion 120.

Generally, flexible straps 115, 116 and 117 may be made of any flexible material. In some embodiments, flexible straps 115, 116 and 117 may be made of a material with an elastic property. In a preferred embodiment, flexible straps 115, 116 and 117 may be made of a suitably flexible material.

Preferably, upper 112 also includes provisions for tightening opening 102 around a wearer's ankle. In this embodiment, upper 112 includes ankle strap 140. Ankle strap 140 is preferably configured to wrap around upper 112 at ankle portion 142. In some embodiments, ankle strap 140 may incorporate a hook and/or loop fastener that may be configured to attach to a corresponding hook and/or loop fastener disposed on upper 112. In a preferred embodiment, ankle strap 140 includes a Velcro © fastening system. It should be understood that other fastening systems may also be used with ankle strap 140.

Upper 112 may also include tongue 150. Tongue 150 is preferably disposed below straps 115-117 and 140. In some embodiments, tongue 150 may be used to further adjust upper 112 to a wearer's foot. In many cases, tongue 150 may provide additional cushioning to the instep region of a wearer's foot, reducing the pressure applied to the foot by straps 115-117.

Although three flexible straps at the instep and one ankle strap are shown in this preferred embodiment, in other embodiments any number of straps or other fasteners may be used. Generally, any kind of fastening system may be used with upper 112. Examples of fastening systems include, but are not limited to, laces, zippers, snapping devices, as well as other kinds of fastening systems.

Article of footwear 100 may include provisions for increasing the flexibility of upper 112. In this preferred embodiment, upper 112 may include first upper slot 161, second upper slot 162, third upper slot 163 and fourth upper slot 164, disposed on or near instep portion 120. Preferably, upper slots 161-164 extend from lateral side 170 to medial side 171 of upper 112.

Figure 2:
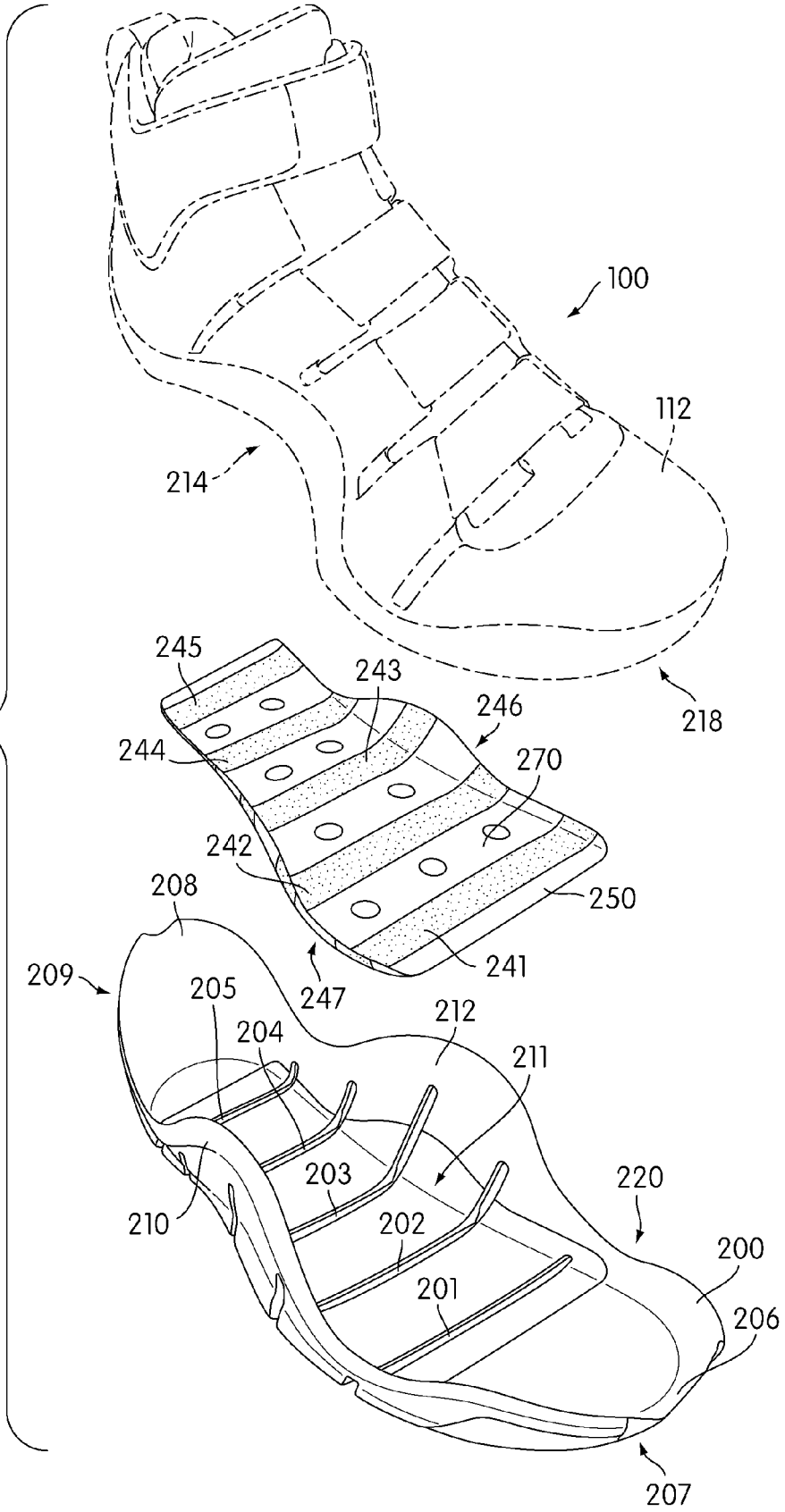
FIG. 2 is an exploded isometric view of a preferred embodiment of an article of footwear.
Figure 3:
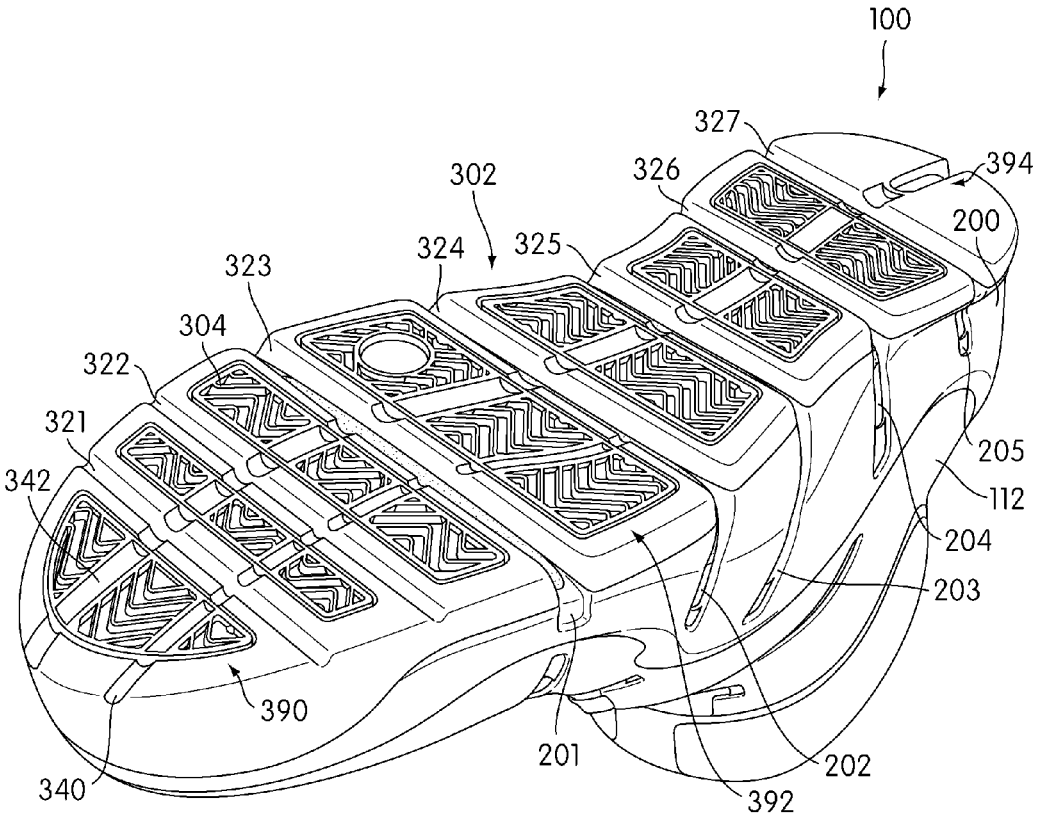
FIG. 3 is an isometric view of a preferred embodiment of the bottom of an article of footwear.

Referring to FIGS. 2-3, upper 112 may be associated with outer member 200 and inner plate 250. Outer member 200 may provide additional support along the base of article of footwear 100. In a preferred embodiment, outer member 200 may be shaped in the general contour of a foot. In some embodiments, outer member 200 may include toe member 206 and heel member 208 that extend vertically from toe portion 207 and heel portion 209, respectively. Outer member 200 may also include lateral flap 210 and medial flap 212 that may be configured to insert into first arch gap 214 and a second arch gap (not shown) of upper 112, respectively. Preferably, upper periphery 220 of outer member 200 is configured to attach to lower periphery 218 of upper 112.

Preferably, outer member 200 includes provisions to facilitate bending. In some embodiments, outer member 200 may include a set of horizontal slots. Preferably, outer member 200 includes first horizontal slot 201, second horizontal slot 202, third horizontal slot 203, fourth horizontal slot 204, and fifth horizontal slot 205. Generally, horizontal slots 201-205 are disposed on central portion 211, between toe portion 207 and heel portion 209, of outer member 200 and extend through the entire depth of central portion 200. Also, in some embodiments, horizontal slots 201-205 may partially extend along flaps 210 and 212. Using this horizontal slot configuration, outer member 200 may be configured to bend more easily than a solid outer member.

In some cases, outer member 200 may be made of a soft and flexible material that generally facilitates bending. In some embodiments, outer member 200 may be made of a type of foam or soft plastic. In other embodiments, outer member 200 may be made of ethyl-vinyl-acetate (EVA), polyurethane, elastomers, as well as other synthetic materials. In a preferred embodiment, outer member 200 may be made of phylon.

While horizontal slots 201-205 may be useful for facilitating bending, they may also expose inner portions of article of footwear 100 to the ground, including sharp objects such as rocks that may penetrate through horizontal slots 201-205 and harm the wearer's foot. In some embodiments, article of footwear 100 may include provisions that reduce the tendency for objects to pass through outer member 200, via horizontal slots 201-205.

Preferably, inner plate 250 may include provisions for reinforcing outer member 200, especially in the regions associated with horizontal slots 201-205. In some embodiments, inner plate 250 may include a set of protective strips. In the preferred embodiment, inner plate 250 may include first protective strip 241, second protective strip 242, third protective strip 243, fourth protective strip 244 and fifth protective strip 245. Generally, protective strips 241-245 may be oriented horizontally, or in other words, from medial side 246 to lateral side 247 of inner plate 250.

Protective strips 241-245 may be made of a substantially rigid and durable material. In particular, it is preferable that strips 241-245 are resistant to puncturing. Additionally, protective strips 241-245 may be made of a material that is also lightweight, to maintain a generally lightweight design for article of footwear 100. In a preferred embodiment, protective strips 241-245 are made of a carbon fiber tape. It should be understood, however, that in other embodiments protective strips 241-245 may be made from other materials that are substantially rigid, durable and lightweight.

In a preferred embodiment, protective strips 241-245 may be embedded in matrix material 270 that is generally shaped to fit within outer member 200. Examples of possible materials used to make matrix material 270 include, but are not limited to, elastomers, natural rubbers, synthetic rubbers, various types of plastics, as well as EVA, polyurethane, and other types of materials. In one embodiment, matrix material 270 may be made of TPU to provide flexibility.

In some embodiments, outer member 200 may be further associated with a treaded surface configured to contact the ground and provide additional traction to article of footwear 100. In the preferred embodiment shown in FIG. 3, outer member 200 includes treaded member 302. Treaded member 302 may be integrally formed with outer member 200 in some embodiments. In other embodiments, treaded member 302 may be made independently from outer member 200 and attached to outer member 200 using an adhesive. Treaded member 302 may be made of a similar material to outer member 200 or it may be made of traditional materials used with shoe outsoles. Examples of such materials include, but are not limited to, elastomers, siloxanes, foams, natural rubber, other synthetic rubbers, aluminum, steel, natural leather, synthetic leather, or plastics. In the preferred embodiment, treaded member 302 includes tread pattern 304.

Preferably, treaded member 302 includes provisions to facilitate the bending of outer member 200. In some embodiments, treaded member 302 may also include horizontal slots that facilitate bending. In this embodiment, treaded member 302 includes first tread slot 321, second tread slot 322, third tread slot 323, fourth tread slot 324, fifth tread slot 325, sixth tread slot 326 and seventh tread slot 327. In this preferred embodiment, horizontal slots 321 and 322 are generally shallower than horizontal slots 323-327. In particular, tread slots 323-327 preferably extend through treaded member 302 and align with horizontal slots 201-205 of outer member 200. Using this horizontal slot configuration, outer member 200 and treaded member 302 may facilitate bending along the bottom of article of footwear 100.

In some embodiments, treaded member 302 may include first long slot 340 and second long slot 342. Preferably, first long slot 340 and second long slot 342 extend lengthwise along treaded member 302. First long slot 340 may extend from toe portion 390 of treaded member 302 to arch portion 392 of treaded member 302. Second long slot 342 may extend from toe portion 390 of treaded member 302 to heel portion 394 of treaded member 302. In some embodiments, long slots 340 and 342 may further facilitate bending and add to overall flexibility.

Figure 4:
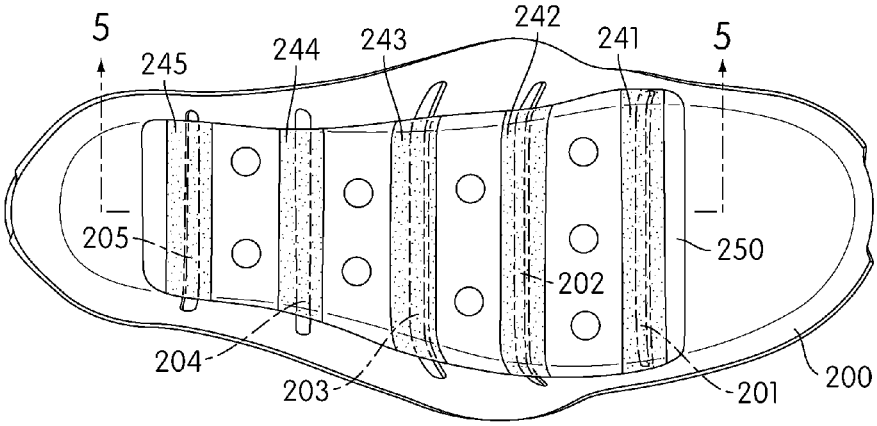
FIG. 4 is a top down view of a preferred embodiment of an outer member.
Figure 5:
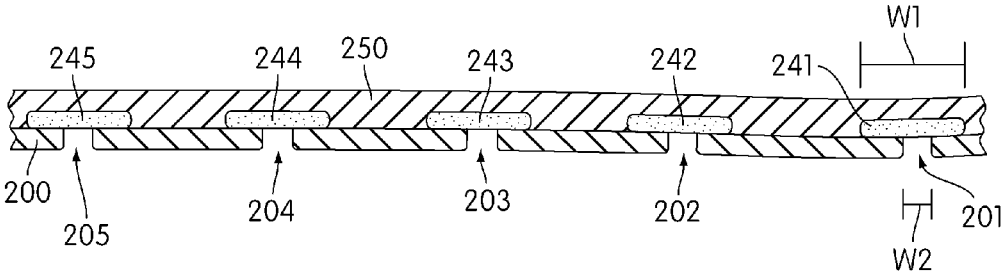
FIG. 5 is a side cross sectional view of a preferred embodiment of an outer member.

Referring to FIGS. 4 and 5, protective strips 241-245 are preferably associated with horizontal slots 201-205 (shown in phantom), when article of footwear 100 is assembled. In the preferred embodiment shown in the figures, protective strips 241-245 may be configured to align with, and cover, horizontal slots 201-205. In other words, protective strips 201-205 may be spaced within inner plate 250 so that they are disposed just over horizontal slots 201-205, as seen in FIGS. 4 and 5.

Figure 6:
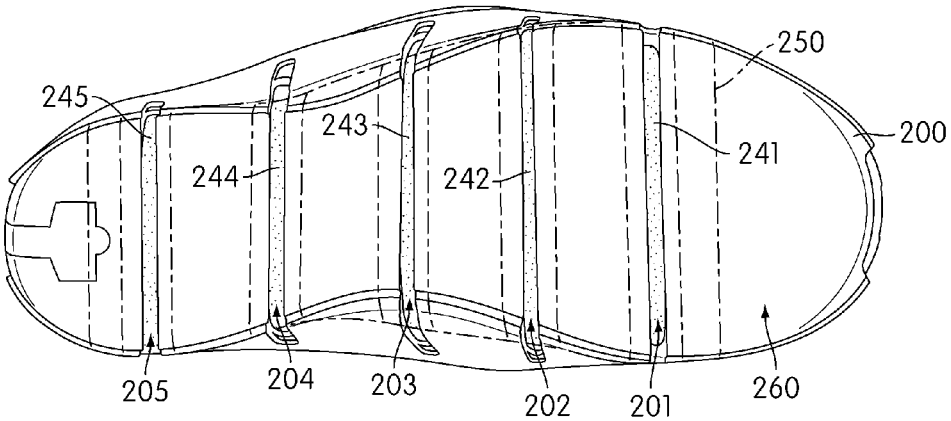
FIG. 6 is a top down view of a preferred embodiment of the bottom of an outer member.

FIG. 6 is a view of a preferred embodiment of bottom side 260 of outer member 200. Inner plate 250 is preferably disposed within outer member 200. For clarity, treaded member 302 is not shown here. This bottom view is intended to illustrate the fact that protective strips 241-245 are visible through horizontal slots 201-205. In fact, it is clear from FIGS. 4-6 that protective strips 241-245 have a width W1 that is greater than the width W2 of horizontal slots 201-205. Therefore, even if horizontal slots 201-205 are widened by a tension or bending force applied to outer member 200, protective strips 241-245 may still cover the widened horizontal slots 201-205.

Figure 7:
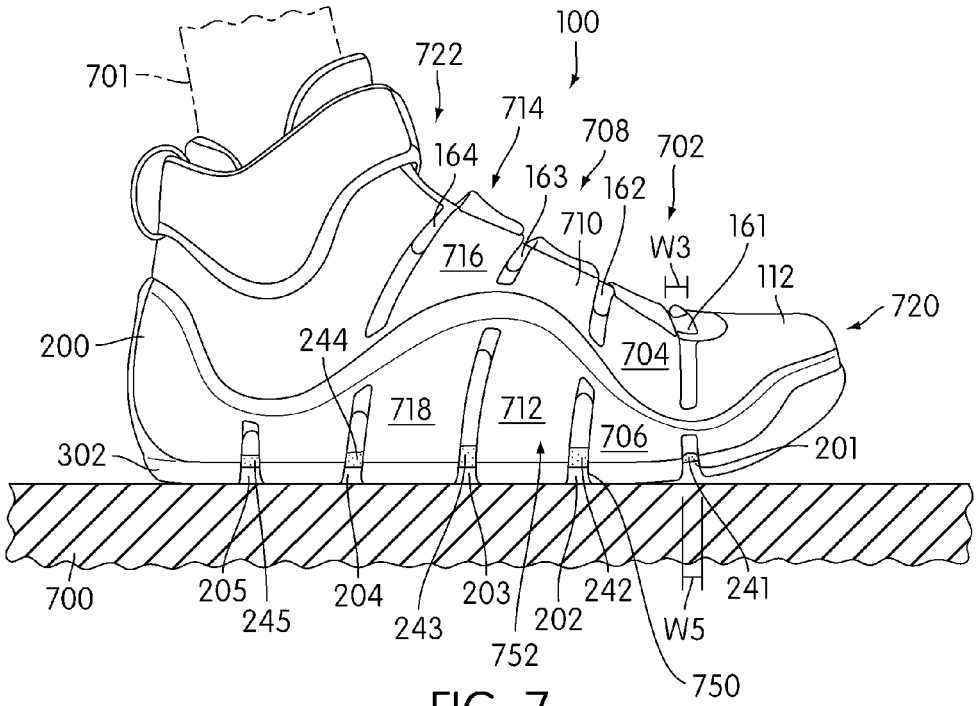
FIG. 7 is a side view of a preferred embodiment of an article of footwear.
Figure 8:
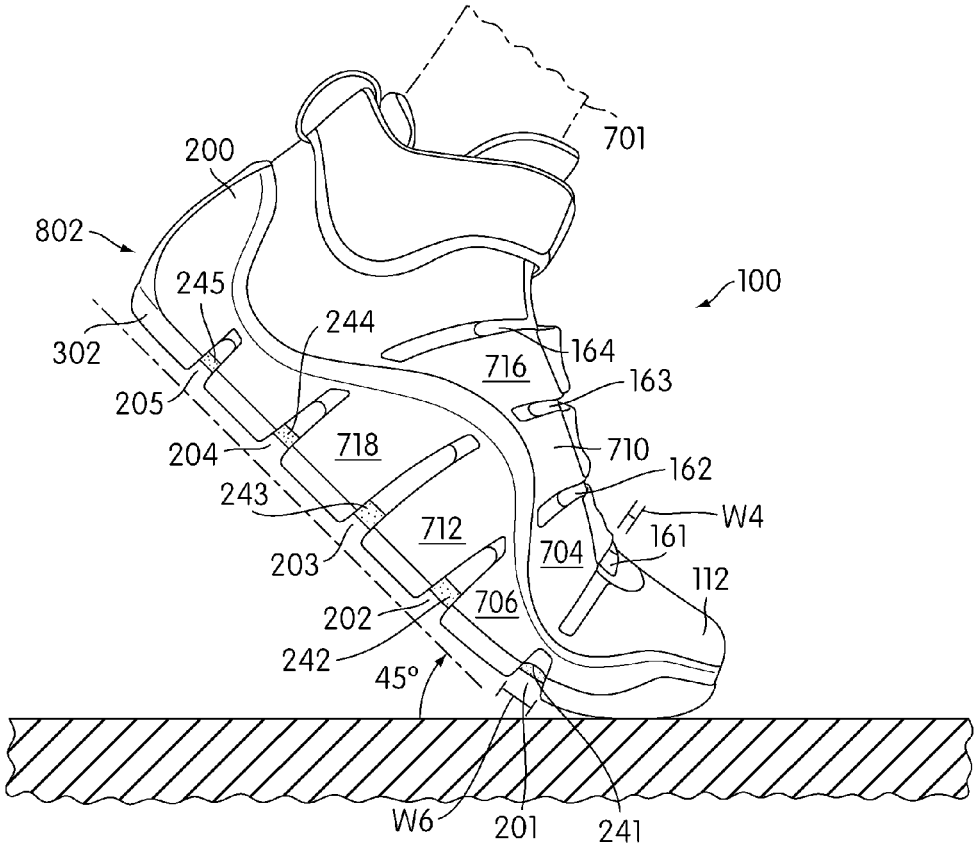
FIG. 8 is a side view of a preferred embodiment of an article of footwear.

As a wearer of article of footwear 100 walks, runs or even jumps, article of footwear 100 may bend or flex, especially as a wearer's foot is lifted off of the ground. FIGS. 7-8 are intended to illustrate the bending and/or flexing of article of footwear 100 during walking, running or jumping.

During a first horizontal mode, seen in FIG. 7, article of footwear 100 is disposed against ground surface 700 in a horizontal position. This configuration may represent the orientation of article of footwear 100 just after a wearer has stepped down on ground surface 700 with foot 701 (shown in phantom). As previously discussed, article of footwear 100 includes slots along upper 112, outer member 200 and treaded member 302. Preferably, upper slots 161-164 of upper 112 may be aligned with horizontal slots 201-204 of outer member 200.

Preferably, protective strips 241-245 are also visible through horizontal slots 201-205. In some embodiments, a first portion 750 of second protective strip 242 may be exposed through second horizontal slot 202, along side periphery 752 of outer member 200. In a similar manner, protective strips 241 and 243-245 may be partially exposed through horizontal slots 201 and 203-205 along side periphery 752 of outer member 200. With this preferred configuration, protective strips 241-245 may reduce the tendency of any object to enter horizontal slots 201-205, including entry at side periphery 752, protecting a wearer's foot from injury due to sharp objects.

With the preferred arrangement shown in the figures, article of footwear 100 generally comprises three distinct vertical portions that may be divided according to these various slots. In particular, first vertical portion 702 comprises first upper portion 704 and first lower portion 706. First upper portion 704 is disposed between first upper slot 161 and second upper slot 162, and first lower portion 706 is disposed between first horizontal slot 201 and second horizontal slot 202. Second vertical portion 708 comprises second upper portion 710 and second lower portion 712. Second upper portion 710 is disposed between third upper slot 163 and second upper slot 162 while second lower portion 712 is disposed between second horizontal slot 202 and third horizontal slot 203. Finally, third vertical portion 714 comprises third upper portion 716 and third lower portion 718. Third upper portion 716 is disposed between third upper slot 163 and fourth upper slot 164 while third lower portion 718 is disposed between third horizontal slot 203 and fourth horizontal slot 204. In addition to vertical portions 702, 708 and 714, article of footwear 100 comprises forward portion 720, disposed forward of first upper slot 161 and first horizontal slot 201, as well as rearward portion 722, disposed rearward of fourth upper slot 164 and fourth horizontal slot 204.

Using this configuration, each of these vertical portions 702, 708 and 714 may move somewhat independently of one another, allowing article of footwear 100 to achieve increased flexibility. In some cases, upper portions 704, 710 and 716 may move closer together or farther apart from one another. Likewise, lower portions 706, 712 and 718 may also move closer together or farther apart from one another. This preferred arrangement may help facilitate various modes of bending or flexing of article of footwear 100, especially at upper 112 and outer member 200.

Proceeding from FIG. 7 to FIG. 8, article of footwear 100 is seen to change from the horizontal mode to a flexing mode. As a wearer begins to walk, run or jump, their heel tends to raise first while the toes or forefoot remain planted. This results in a bending or flexing of the foot. The slot configuration of the preferred embodiment helps to allow article of footwear 100 to flex and bend substantially.

As seen in FIG. 8, as heel portion 802 of article of footwear 100 is raised at an angle of 45 degrees or so, upper 112 and outer member 200 preferably flex and/or bend. In particular, upper 112 tends to compress, as the widths of upper slots 161-164 get narrower, bringing upper portions 704, 710 and 716 closer together. In this embodiment, first upper slot 161 is originally associated with a width W3, during the horizontal mode seen in FIG. 7. During the flexing mode, seen in FIG. 8, first upper slot 161 is associated with a width W4 that is less than width W3. The widths of upper slots 162-164 also preferably decrease in a similar manner to first upper slot 161, as article of footwear 100 proceeds from the horizontal mode to the flexing mode.

On the other hand, outer member 200 preferably flexes while upper 112 is compressing. In particular, horizontal slots 201-205 may expand, pushing lower portions 706, 712 and 718 further apart. In this embodiment, first horizontal slot 201 is associated with a width W5 during the horizontal mode and a width W6 that is greater than width W5 during the flexing mode. The widths of horizontal slots 202-205 also preferably increase in a manner similar to first horizontal slot 201, as article of footwear 100 proceeds from the horizontal mode to the flexing mode.

It should be understood that the flexing mode undergone by article of footwear 100 in FIG. 8 is only meant to be illustrative of how article of footwear 100 may flex and bend during motions associated with walking, running and/or jumping. In other embodiments, article of footwear 100 could undergo various other modes of bending or flexing, especially modes of flexing or bending associated with typical configurations of an article of footwear during walking, running and/or jumping.

In some cases, article of footwear 100 may include additional provisions for cushioning a wearer's foot. In some embodiments, article of footwear 100 may include an inner lining or 'bootie' configured to wrap around a wearer's foot in a manner similar to a sock. Furthermore, article of footwear 100 may include a cushioning midsole and/or insole. In a preferred embodiment, article of footwear 100 may include a midsole that is inserted within upper 112, which is configured to contact a wearer's foot directly.

Figure 9:
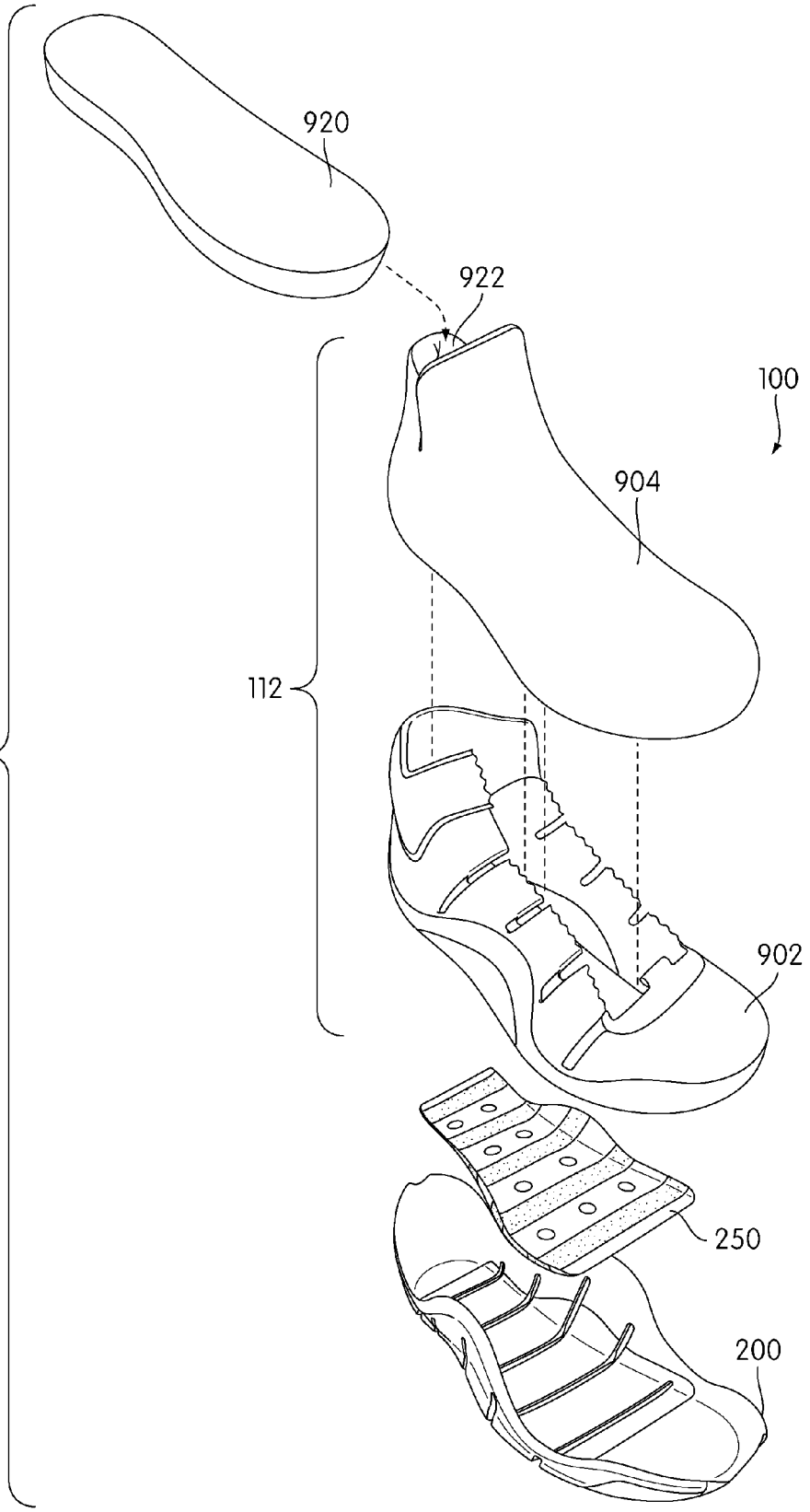
FIG. 9 is an isometric view of a preferred embodiment of an article of footwear including a midsole.
Figure 10:
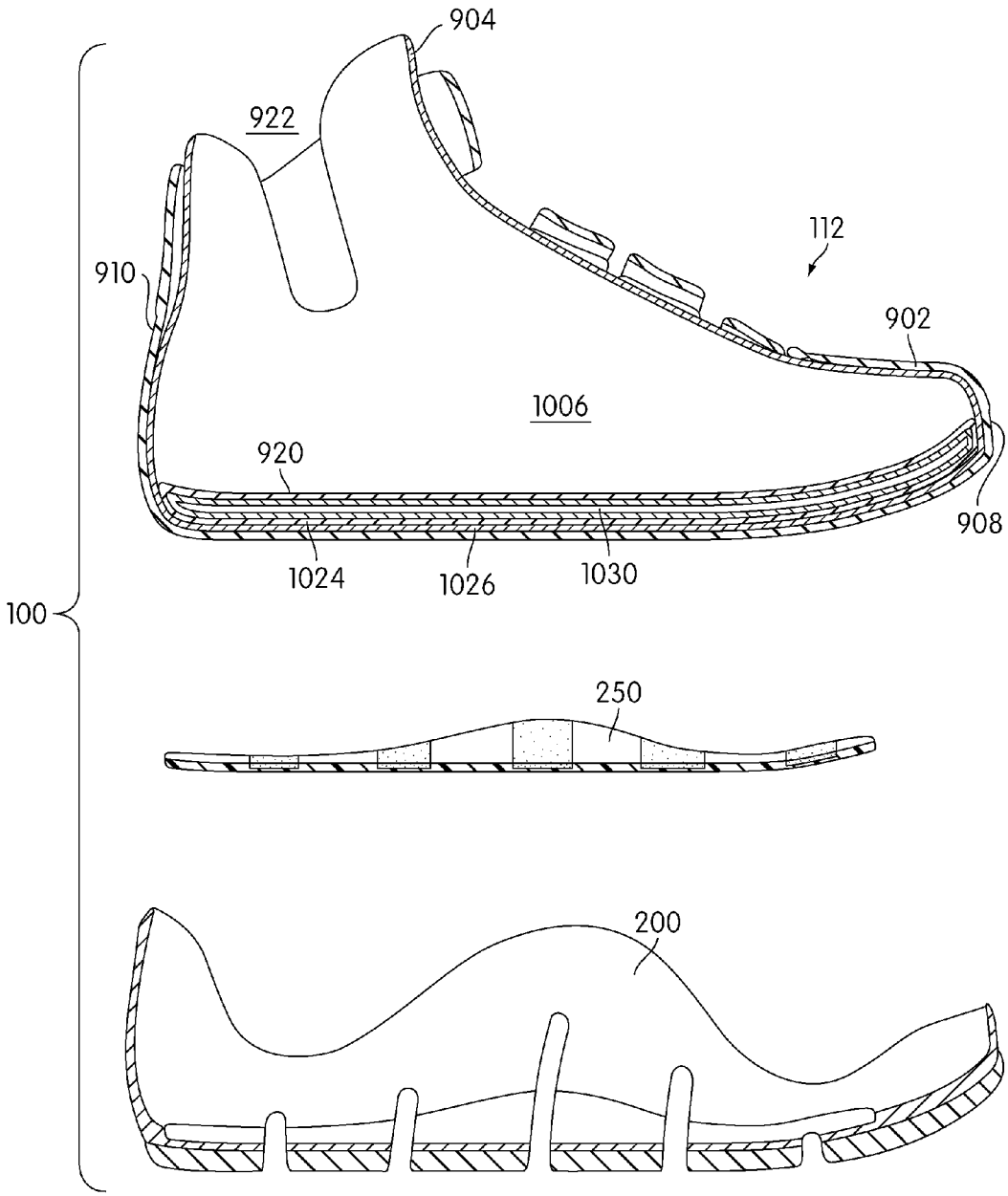
FIG. 10 is a side cross sectional view of a preferred embodiment of an article of footwear including a midsole.

FIGS. 9 and 10 illustrate another preferred embodiment of article of footwear 100. As with the previous embodiments, article of footwear 100 preferably includes upper 112, inner plate 250 and outer member 200. In particular, inner plate 250 is preferably disposed between outer member 200 and upper 112.

In this preferred embodiment, upper 112 includes outer lining 902 and inner lining 904. Generally, inner lining 904 is configured to contact a wearer's foot, once it has been inserted into inner cavity 1006 of upper 112, as seen in FIG. 10, an assembled cross sectional view of upper 112. Inner lining 904 may be a sock-like bootie that wraps around a wearer's foot within outer lining 902. Preferably, inner lining 904 is made of a soft and flexible material that helps provide comfort to a wearer's foot. Inner lining 904 may be made of any fabric, including both natural and synthetic materials, as well as any other soft and flexible material commonly used in 'booties' found within articles of footwear.

In some embodiments, outer lining 902 may be configured to provide additional support or to reinforce inner lining 904. Preferably, outer lining 902 is made of a more durable material than inner lining 904. Outer lining 902 could be made of any material commonly associated with footwear uppers, including those materials previously discussed with respect to upper 112. In some embodiments, outer lining 902 may also be made of phylon. Using this multi-layered configuration, a wearer's foot may be better protected, especially at toe portion 908 and heel portion 910, as inner plate 250 and outer member 200 may generally serve to protect a wearer's foot from below.

Preferably, upper 112 is also associated with midsole 920. Midsole 920 may be disposed within inner cavity 1006 of upper 112. In some embodiments, midsole 920 may be inserted into upper 112 via opening 922 of inner lining 904. In a preferred embodiment, bottom side 1024 of midsole 920 may be glued to inner side 1026 of inner lining 904. This preferred arrangement may decrease this tendency of midsole 920 to slip with respect to upper 112. In other embodiments, midsole 920 may not be fixed in place within inner cavity 1006.

In some embodiments, midsole 920 may further include bladder 1030. Preferably, bladder 1030 comprises a flexible outer material that is impermeable to fluids as well as a core. In some embodiments, the outer material may comprise a thermoplastic elastomer material that is impermeable to fluid. Also, the core may comprise various filaments that are fused to an outer barrier. The preferred type of bladder that may be included as part of midsole 920 can be found in U.S. Pat. No. 7,070,845 and U.S. Pat. No. 6,837,951, the entirety of which are incorporated here by reference. In this preferred embodiment, bladder 1030 extends along a majority of the length of midsole 920. This arrangement may provide additional cushioning to a wearer's foot.

Figure 11:
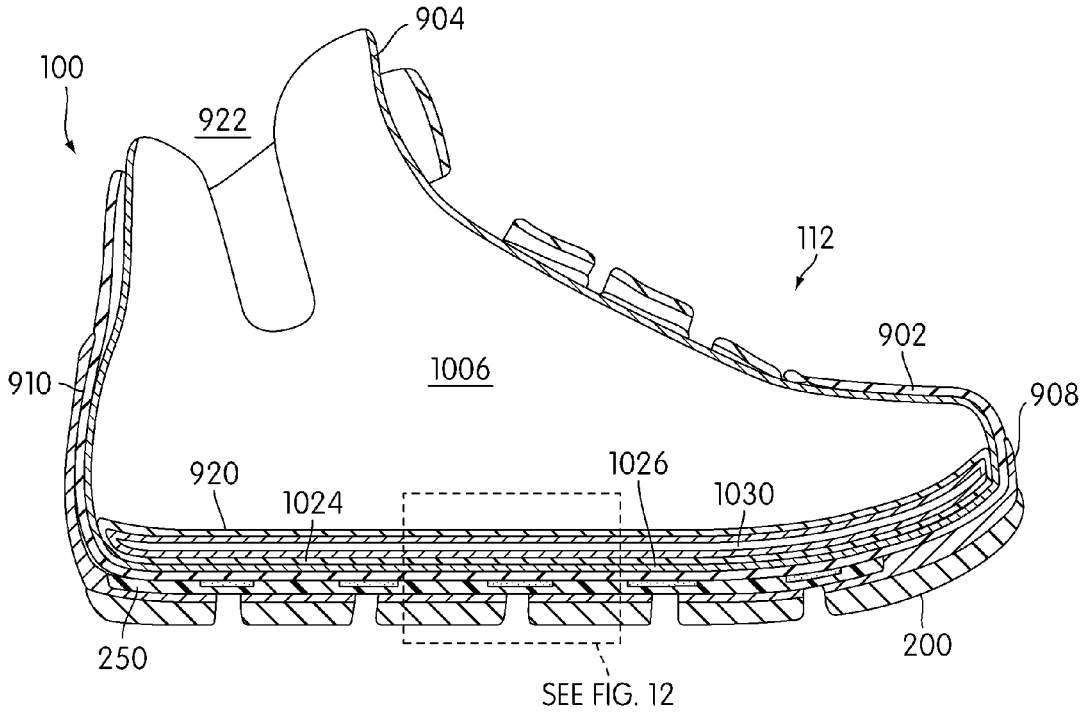
FIG. 11 is a side cross sectional view of a preferred embodiment of an article of footwear.
Figure 12:
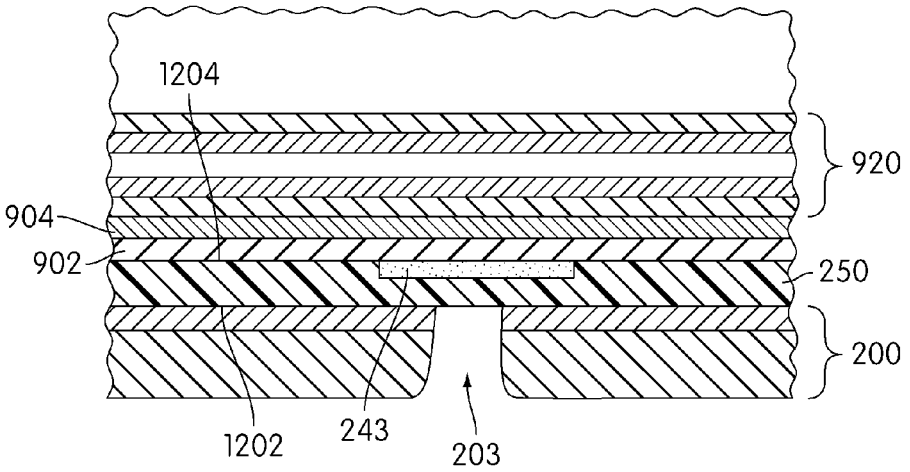
FIG. 12 is a close up side cross sectional view of a preferred embodiment of an article of footwear.

As article of footwear 100 is assembled, shown in FIGS. 11 and 12, inner plate 250 may be fixed directly to outer lining 902 of upper 112. For the purposes of illustration, the thickness of inner plate 250 has been exaggerated. In some embodiments, second side 1204 of inner plate 250 may be glued to outer lining 902. In other embodiments, inner plate 250 may be fixed to outer lining 902 using another type of adhesive. With this configuration, inner plate 250 may not slip with respect to upper 112.

In some embodiments, outer member 200 may also be fixed directly to outer lining 902. Preferably, outer member 200 and outer lining 902 may be attached using glue or another type of adhesive. Furthermore, first side 1202 of inner plate 250 may also be attached to outer member 200 using some type of adhesive. Using this preferred arrangement, outer member 200, inner plate 250 and upper 112 may not slide with respect to one another.

In this embodiment, first side 1202 of inner plate 250 is fixed just above outer member 200. Preferably, protective strip 243 of inner plate 250 is disposed over slot 203. As previously discussed, this preferred configuration may reduce the tendency of objects to penetrate into upper 112. In the preferred embodiment, outer lining 902 is also attached to second side 1204 of inner plate 250. This preferred multi-layered configuration allows for increased flexibility and support of article of footwear 100.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear comprising:

an upper defining a first upper slot, a second upper slot, and a third upper slot, each of the first, second, and third upper slots extending from a lateral side of the upper to a medial side of the upper;

the second upper slot being disposed rearward of the first upper slot, and the third upper slot being disposed rearward of the second upper slot;

an outer member disposed at a bottom side of the upper;

the outer member defining a first outer member slot, a second outer member slot, and a third outer member slot, each of the first, second, and third outer member slots extending through an entire depth of the outer member from a lateral side of the outer member to a medial side of the outer member;

the first upper slot being aligned with the first outer member slot on a lateral side and a medial side of the article of footwear;

the second upper slot being aligned with the second outer member slot on the lateral side and the medial side of the article of footwear;

the third upper slot being aligned with the third outer member slot on the lateral side and the medial side of the article of footwear;

wherein the first, second, and third upper slots are narrower when in a flexing mode of the article of footwear in which the outer member is in a bent position with a heel of the article of footwear raised relative to a ground surface and with a toe of the article of footwear remaining planted on the ground surface, than when in a horizontal mode of the article of footwear in which the outer member is in a horizontal position with the article of footwear disposed against the ground surface; and wherein the first, second, and third outer member slots are wider when in the flexing mode of the article of footwear than when in the horizontal mode of the article of footwear.

2. The article of footwear according to claim 1, wherein the outer member further comprises:

a central portion that is horizontally disposed under the bottom side of the upper when the article of footwear is in the horizontal mode;

a medial flap that extends away from the central portion and around to the medial side of the article of footwear;

a lateral flap that extends away from the central portion and around to the lateral side of the article of footwear; and wherein the first, second, and third outer member slots extend from the lateral flap, through the central portion, and to the medial flap.

3. The article of footwear according to claim 2, further comprising an inner plate disposed at the upper surface of the outer member and having a protective strip disposed in a matrix;

wherein the protective strip covers the second outer member slot at the lateral flap, the central portion, and the medial flap;

wherein the protective strip terminates in a forward direction of the article of footwear at a first longitudinal edge before reaching the first outer member slot and in a rearward direction of the article of footwear at a second longitudinal edge before reaching the third outer member slot; and wherein the first and second longitudinal edges extend laterally across the article of footwear from the lateral side of the article of footwear to the medial side of the article of footwear.

4. The article of footwear according to claim 3, wherein a width of the protective strip between the first and second longitudinal edges is sufficient to cover the second outer member slot in both the horizontal mode and the flexing mode.

5. The article of footwear according to claim 1, wherein the second upper slot and the second outer member slot are aligned along a first curved line that is concave with respect to a forward portion of the article of footwear when the article of footwear is viewed from a side view.

6. The article of footwear according to claim 5, wherein the third upper slot and the third outer member slot are aligned along a second curved line that is concave with respect to the forward portion of the article of footwear when the article of footwear is viewed from the side view.

7. The article of footwear according to claim 6, wherein the second curved line has a smaller radius of curvature than the first curved line.

8. The article of footwear according to claim 1, wherein the outer member further comprises a first individual protective strip spanning the first outer member slot, a second individual protective strip spanning the second outer member slot, and a third individual protective strip spanning the third outer member slot.

9. The article of footwear according to claim 8, wherein the second individual protective strip is exposed through the second outer member slot.

10. The article of footwear according to claim 9, wherein the second individual protective strip is exposed through the second outer member slot along a side periphery of the outer member.

11. The article of footwear according to claim 8, wherein the first, second, and third protective strips each have a width that is greater than a width of its respective first, second, and third outer member slot, so that the first, second, and third protective strips each span the respective first, second, and third outer member slot in both the horizontal mode and the flexing mode.

12. The article of footwear according to claim 1, further comprising an inner plate comprising a set of spaced-apart protective strips disposed in a matrix;

wherein each protective strip of the set of spaced-apart protective strips is spaced apart from an adjacent protective strip in a lengthwise direction generally extending from a heel portion to a toe portion of the article of footwear;

wherein a first protective strip of the set of spaced-apart protective strips aligns with and covers the first outer member slot;

wherein a second protective strip of the set of spaced-apart protective strips aligns with and covers the second outer member slot; and wherein a third protective strip of the set of spaced-apart protective strips aligns with and covers the third outer member slot.

13. The article of footwear according to claim 1, wherein the upper comprises an outer lining and an inner lining, and wherein the outer lining defines the first, second, and third upper slots.

14. The article of footwear according to claim 1, the upper defining a fourth upper slot disposed rearward of the third upper slot;

the outer member defining a fourth outer member slot aligned with the fourth upper slot on the lateral side and the medial side of the article of footwear;

wherein the fourth upper slot is narrower when in the flexing mode than when in the horizontal mode; and wherein the fourth outer member slot is wider when in the flexing mode than when in the horizontal mode.

15. An article of footwear comprising:

an upper defining a first upper slot, a second upper slot, and a third upper slot, each of the first, second, and third upper slots extending from a lateral side of the upper to a medial side of the upper;

the second upper slot being disposed rearward of the first upper slot;

the third upper slot being disposed rearward of the second upper slot;

an outer member disposed at a bottom side of the upper;

the outer member defining a first outer member slot, a second outer member slot, and a third outer member slot, each of the first, second, and third outer member slots extending through an entire depth of the outer member from a lateral side of the outer member to a medial side of the outer member;

the first upper slot being aligned with the first outer member slot on a lateral side and a medial side of the article of footwear;

the second upper slot being aligned with the second outer member slot on the lateral side and the medial side of the article of footwear;

the third upper slot being aligned with the third outer member slot on the lateral side and the medial side of the article of footwear;

wherein a first upper vertical portion of the article of footwear is defined between the first and second upper slots on the medial and lateral sides of the upper;

wherein a first lower vertical portion of the article of footwear is defined between the first and second outer member slots on the medial and lateral sides of the outer member;

wherein a second upper vertical portion of the article of footwear is defined between the second and third upper slots on the medial and laterals sides of the upper;

wherein a second lower vertical portion of the article of footwear is defined between the second and third outer member slots on the medial and lateral sides of the outer member;

wherein the first and second upper vertical portions are closer together when in a flexing mode of the article of footwear in which the outer member is in a bent position with a heel of the article of footwear raised relative to a ground surface and with a toe of the article of footwear remaining planted on the ground surface, than when in a horizontal mode of the article of footwear in which the outer member is in a horizontal position with the article of footwear disposed against the ground surface; and wherein the first and second lower vertical portions are farther apart when in the flexing mode of the article of footwear than when in the horizontal mode of the article of footwear.

16. The article of footwear according to claim 15, wherein, on the lateral side of the article of footwear, the first upper slot terminates within the upper and short of the outer member and the first outer member slot terminates within the outer member, such that the first upper slot and the first outer member slot are aligned but discontinuous.

17. The article of footwear according to claim 15, wherein the outer member has a horizontal central portion, wherein a portion of the first outer member slot in the central portion has a first outer member slot width measured in a forward to rearward direction of the article of footwear, and wherein the first outer member slot width increases from a narrower first outer member slot width in the horizontal mode to a wider first outer member slot width in the flexing mode.

18. The article of footwear according to claim 17, wherein the first upper slot has a first upper slot width at a top side of the upper, wherein the first upper slot width is measured in the forward to rearward direction of the article of footwear, and wherein the first upper slot width decreases from a wider first upper slot width in the horizontal mode to a narrower first upper slot width in the flexing mode.

19. The article of footwear according to claim 15, further comprising:

a first protective strip that is aligned with and covers the first outer member slot for both a narrower first outer member slot width in the horizontal mode and a wider first outer member slot width in the flexing mode;

a second protective strip that is aligned with and covers the second outer member slot for both a narrower second outer member slot width in the horizontal mode and a wider second outer member slot width in the flexing mode; and wherein the first protective strip is separate from the second protective strip.

20. An article of footwear comprising:

an upper defining a first upper slot and a second upper slot on at least one of a medial side and a lateral side of the upper;

the second upper slot being disposed rearward of the first upper slot;

an outer member disposed at a bottom side of the upper;

the outer member defining a first outer member slot and a second outer member slot, each of the first and second outer member slots extending from a lateral side of the outer member to the medial side of the outer member and comprising an opening through the outer member;

the first upper slot being aligned with the first outer member slot on at least one of a lateral side and a medial side of the article of footwear;

the second upper slot being aligned with the second outer member slot on the at least one of the lateral side and the medial side of the article of footwear;

wherein the first upper slot, the first outer member slot, the second upper slot, and the second outer member slot define a vertical portion of the article of footwear, with the first upper slot and the first outer member slot on a forward side of the vertical portion and the second upper slot and the second outer member slot on a rearward side of the vertical portion;

wherein the first and second upper slots are narrower when in a flexing mode of the article of footwear in which the outer member is in a bent position with a heel of the article of footwear raised relative to a ground surface and with a toe of the article of footwear remaining planted on the ground surface, than when in a horizontal mode of the article of footwear in which the outer member is in a horizontal position with the article of footwear disposed against the ground surface, such that, at a top side of the article of footwear, the vertical portion is closer to adjacent portions of the upper when in the flexing mode than when in the horizontal mode; and wherein the first and second outer member slots are wider when in the flexing mode of the article of footwear than when in the horizontal mode of the article of footwear such that, at a bottom side of the article of footwear, the vertical portion is farther from adjacent portions of the outer member when in the flexing mode than when in the horizontal mode.

21. The article of footwear according to claim 20, further comprising:

a first protective strip that is disposed over the first outer member slot for both a narrower first outer member slot width in the horizontal mode and a wider first outer member slot width in the flexing mode;

a second protective strip that is disposed over the second outer member slot for both a narrower second outer member slot width in the horizontal mode and a wider second outer member slot width in the flexing mode; and wherein the first protective strip is separate from the second protective strip.

* * * * *